US005431206A

United States Patent [19]

McAllister

[11] Patent Number: 5,431,206

[45] Date of Patent: Jul. 11, 1995

[54] PORTABLE WORKSTATION

[76] Inventor: Michael J. McAllister, 125 Shirley Ave., Staten Island, N.Y. 10312

[21] Appl. No.: 140,559

[22] Filed: Oct. 25, 1993

[51] Int. Cl.[6] ..... B27C 9/00

[52] U.S. Cl. ..... 144/286 R; 108/13; 108/62; 144/265; 144/286 A; 144/1 R

[58] Field of Search ..... 248/664; 108/13, 69, 108/62; 144/1 R, 286 R, 286 A, 285; 83/574

[56] References Cited

U.S. PATENT DOCUMENTS

| | | | |
|---|---|---|---|
| 1,942,834 | 1/1934 | Reilley | 144/1 R |
| 2,319,025 | 5/1943 | Wehringer | 108/62 |
| 2,528,935 | 11/1950 | Williams | 108/62 |
| 2,653,634 | 9/1953 | Mott | 144/285 |
| 2,903,312 | 9/1959 | Lawless | 108/62 |
| 3,672,312 | 6/1972 | Pettit et al. | 108/69 |
| 3,734,151 | 5/1973 | Skripsky | 144/286 R |
| 4,209,045 | 6/1980 | Bassett | 144/1 G |
| 4,265,284 | 5/1981 | Taylor | 144/287 |
| 4,335,765 | 6/1982 | Murphy | 144/286 R |
| 4,523,617 | 6/1985 | Tiedemann | 108/59 |
| 4,700,513 | 10/1987 | Smith | 144/285 |
| 4,733,704 | 3/1988 | Wolff | 144/1 R |
| 5,115,847 | 5/1992 | Taber | 144/287 |
| 5,239,934 | 8/1993 | Miller et al. | 144/286 R |

*Primary Examiner*—W. Donald Bray
*Attorney, Agent, or Firm*—David L. Baker; Henry S. Miller; Rhodes & Ascolillo

[57] ABSTRACT

In a preferred embodiment, a portable workstation, including: a support structure; a horizontal, generally planar, working surface disposed upon and supported by the support structure; a plurality of tools mounted on the working surface, each of the plurality of tools being mounted on a horizontal mounting plate, the mounting plate forming a portion of the working surface, and the mounting plate being rotatable such that each of the plurality of tools may be selectively rotated between a working position on top of the working surface and a stored position underneath the working surface.

1 Claim, 2 Drawing Sheets

PORTABLE WORKSTATION

BACKGROUND OF THE INVENTION

1. Field of the Invention

The present invention relates to tools generally and, more particularly, but not by way of limitation, to a novel portable workstation which includes therein a variety of specialized tools and which is especially useful for construction sites.

2. Background Art

Carpenters and other contractors who work in different locations frequently have need for one or more specialized woodworking tools. However, many such persons desire not to transport a variety of relatively large and heavy woodworking tools to the job sites. Instead, they try to make do with only circular and reciprocating saws. While these tools are usually sufficient to complete a job, the work proceeds more slowly and painstakingly than it would if specialized tools were available at the job site.

Some attempts to provide workstations which are portable and which include a variety of specialized tools are described below:

U.S. Pat. No. 3,672,312 issued Jun. 27, 1972 to Pettit et al., describes a work table having a multiposition extension board mounted at its edge which may be positioned alternatively in any one of three positions: the board extending from the edge of the table; the board projecting upwardly adjacent to the edge of the table, acting as a limiting stop; and, the board stowed beneath the table. This device has no provision to accommodate and compactly store a variety of work tools mounted to or under its surface, nor can the user utilize each side of the extension board.

U.S. Pat. No. 4,209,045, issued Jun. 24, 1980 to Bassett, describes a combination table saw which includes a table base, a carriage mounted on the base and having a screw jack for moving it forwardly and backwardly relative to its base, a main table top mounted on the carriage, an adjustable auxiliary table unit and a fence. Cooperating vise jaws may be mounted on the carriage and on the table base, the jaws being movable by the screw jack. This device does not provide a variety work tools which are stowable underneath the main working surface of the table top.

U.S. Pat. No. 4,265,284, issued May 5, 1981 to Taylor, describes a work bench having a rigid frame support with telescoping legs and a flat topped work surface, a clamping member mounted on guide rails, and a guide fence. While the device can accommodate a circular saw, the mounting surface is not equipped with rotatable surface mounts for other tools that might be needed at a remote location such as a construction site.

U.S. Pat. No. 5,115,847, issued May 26, 1992 to Taber, describes an adjustable support apparatus for use with table saws, the device having a pair of adjustable clamp units selectively disposed on extension arms which are connected to the table saw. This device is specifically designed as an attachment to a table saw device and does not provide a multi-purpose work surface upon which a variety of tasks can be performed.

Accordingly, it is a principal object of the present invention to provide a portable workstation which has stored or mounted therein a variety of tools.

It is a further object of the invention to provide such a workstation in which the stored tools may be easily and conveniently moved to operating positions.

It is an additional object of the invention to provide such a workstation which is easily transported to a job site.

It is another object of the invention to provide such a workstation which is economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a portable workstation, comprising: a support structure; a horizontal, generally planar, working surface disposed upon and supported by said support structure; a plurality of tools mounted on said working surface, each of said plurality of tools being mounted on a horizontal mounting plate, said mounting plate forming a portion of said working surface, and said mounting plate being rotatable such that said each of said plurality of tools may be selectively rotated between a working position on top of said working surface and a stored position underneath said working surface.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
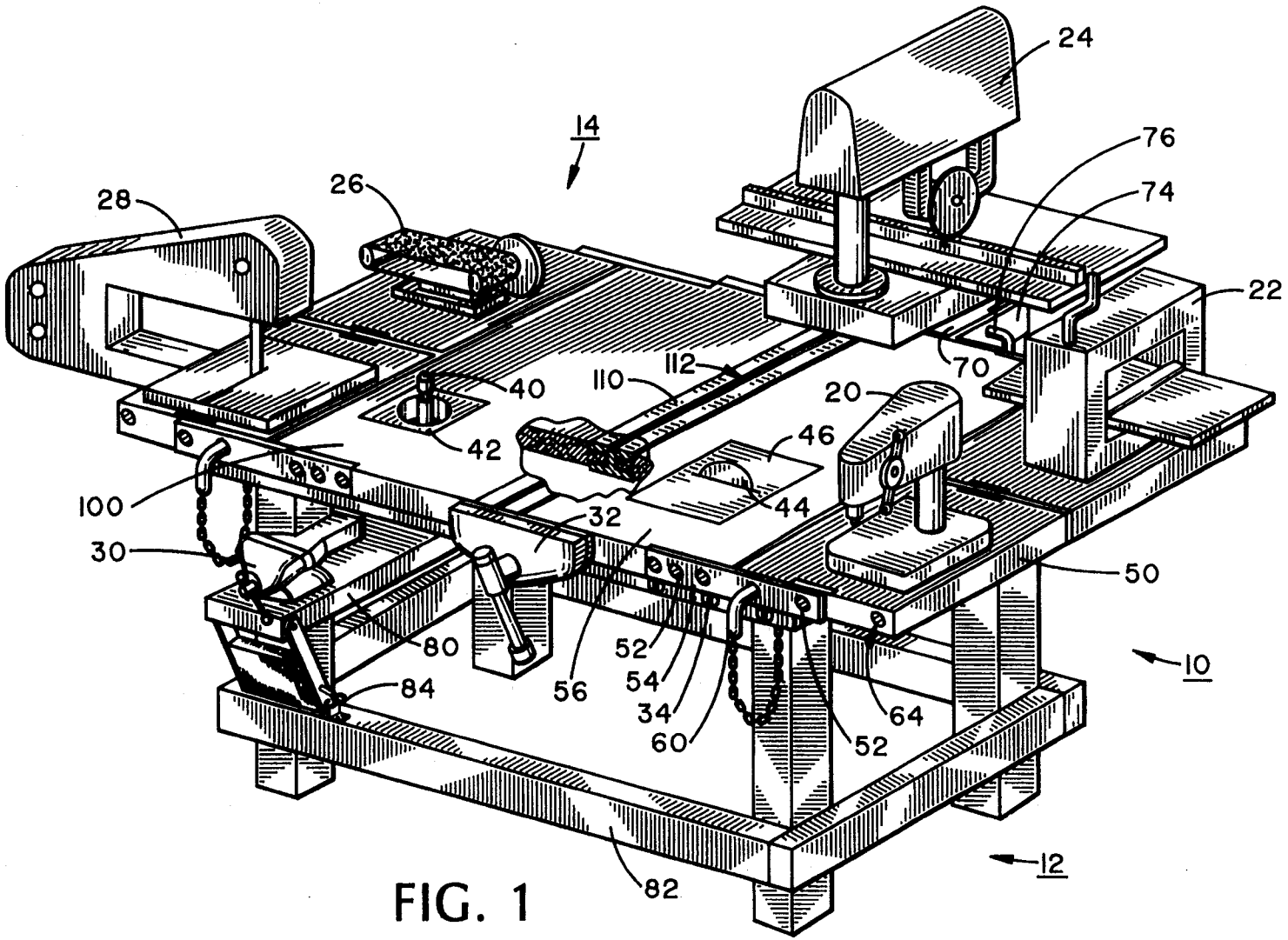
FIG. 1 is an isometric view of a workstation constructed according to the present invention, with a variety of tools in operating position and with a partial cutaway section showing the two stationary upper portions being joined by a double channel.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a portable workstation, generally indicated by the reference numeral 10, having a rectilinear, open, lower support structure, generally indicated by the reference numeral 12, on which is mounted a generally planar, horizontal, upper working surface, generally indicated by the reference numeral 14.

Workstation 10 has mounted thereon a variety of tools, including a drill press 20, a planer 22, a radial arm saw 24, a bench sander 26, a band saw 28, a steel vise 30, a bench vise 32, and electrical outlets, as at 34, for the connection thereto of power tools. Also indicated on FIG. 1 is a router bit 40 extending through a router mounting plate 42 and a circular saw blade 44 extending through a circular saw mounting plate 46.

Figure 2:
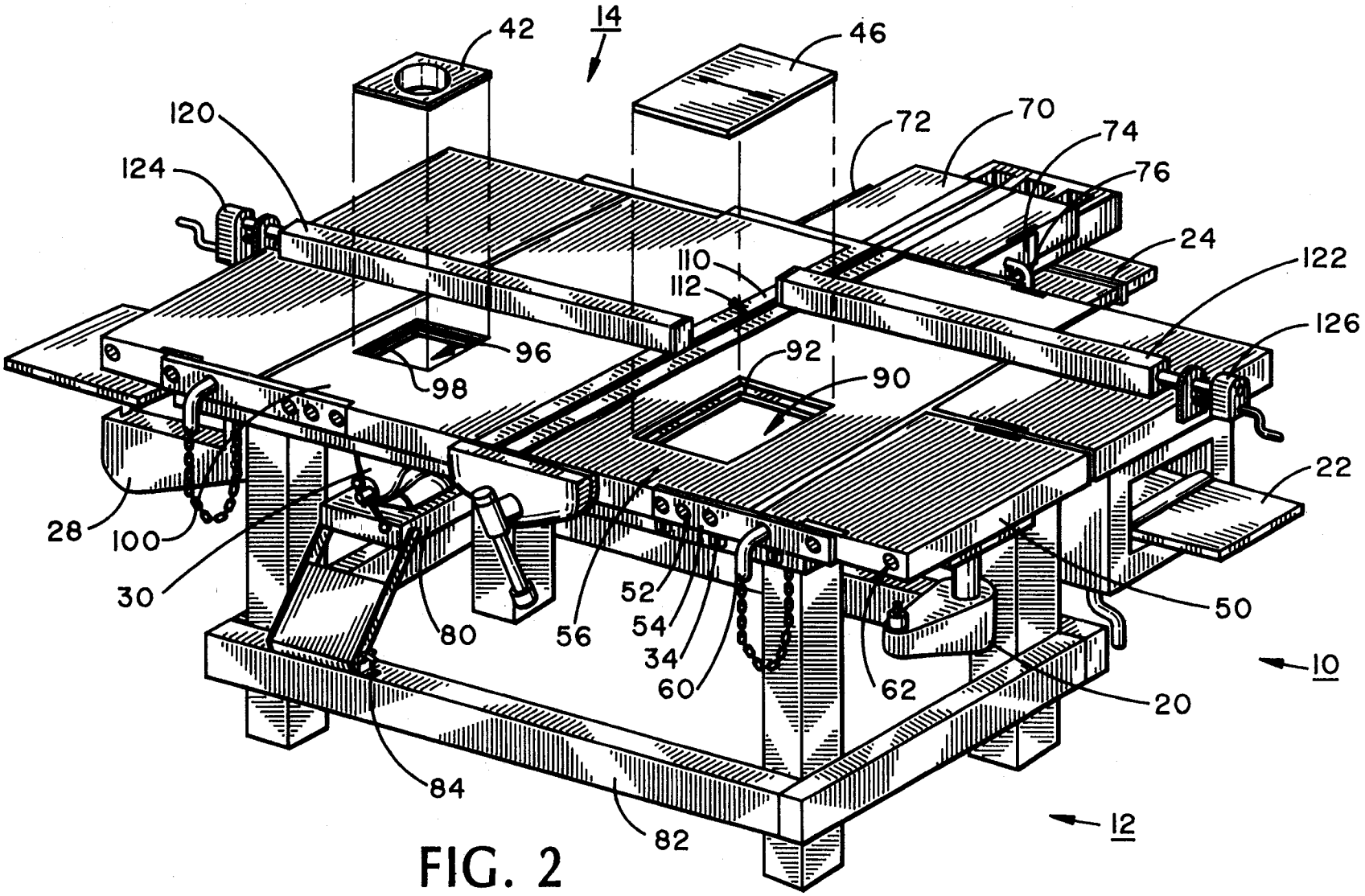
FIG. 2 is an isometric view of the workstation of FIG. 1, with the tools in stored or demounted position.

Reference now should also be made to FIG. 2 which indicates the above tools in their stored positions. Drill press 20 is mounted on a horizontal mounting plate 50 which forms a portion of upper surface 14 and which is rotatingly mounted on a shaft 52 which extends medially through the mounting plate 50. Shaft 52 extends between an end plate 54, which is bolted to an edge of a first stationary portion 56 of upper surface 14, and another end plate (not shown) which is bolted to an opposite edge of first stationary portion 56. Horizontal plate 50 is held in the position shown on FIG. 1, with drill press 20 in operating position, by means of a securing mechanism which may consist of a pin 60 which is inserted through end plate 54 and into a hole 62 (FIG. 2) defined in the edge of the horizontal plate. Pin 60 includes a detent mechanism (not shown) to hold the pin in place.

When it is desired to place drill press 20 in its stored position, pin 60 is removed from hole 62, thus rotatably freeing horizontal plate 50, the horizontal plate is rotated 180 degrees to the position shown on FIG. 2, with the drill press now underneath upper surface 14, and the pin is inserted into a hole 64 (FIG. 1) defined in the edge of the horizontal plate 50. To place drill press 20 in operating position, the foregoing procedure is reversed. It will be understood that moving drill press 20 between operating and stored positions takes only a few seconds. Similar procedures move planer 22, bench sander 26, and band saw 28 between operating (FIG. 1) and stored (FIG. 2) positions.

Radial arm saw 24 is mounted on a horizontal plate 70 rotatably mounted to end plates 72 and 74 which are fixed to an edge of upper surface 14. A pin 76 inserted through end plate 74 into horizontal plate 70 maintains radial arm saw 24 in either its operating (FIG. 1) or stored (FIG. 2) positions.

Steel vise 30 is fixedly mounted on a shelf 80, the shelf being rotatably mounted to a horizontal rail 82 of lower support structure 12 such that the shelf may be moved between an operating position (FIG. 1) in which the jaws of the steel vise 30 are disposed exteriorly of the edge of upper surface 14 and a stored position (FIG. 2) in which the steel vise is disposed interiorly of workstation 10.

Referring to FIG. 2, it will be seen that circular saw mounting plate 46 is insertable into an opening 90 defined through first stationary portion 56 and, when so inserted, the circular saw mounting plate will rest on and be supported by a flange 92 formed around the lower periphery of the opening 90. It will also be seen in FIG. 2 that router mounting plate 42 is insertable into an opening 96 defined through a second stationary portion 100 and, when so inserted, the router mounting plate 42 will rest on and be supported by a flange 98 formed around the lower periphery of the opening 96. When it is desired to use circular saw blade 44 (FIG. 1), a circular saw (not shown) will be attached to the lower surface of mounting plate 46, and the plate 46 placed in opening 90 and onto flange 92 (FIG. 2). Similarly, when it is desired to use router bit 40 (FIG. 1), a router (not shown) will be attached to the lower surface of mounting plate 42 and the plate placed in opening 96 and onto flange 98. Alternatively, a router and circular saw (not shown) could be more permanently mounted under upper surface 14 and router bit 42 and circular saw blade 44 (both FIG. 1) lowered beneath upper surface 14 when not in use.

First and second stationary portions, 56 and 100 respectively, of upper surface 14 are joined medially thereof by a double channel member 110 (see cutaway section in FIG. 1) having defined in the upper surface thereof a longitudinally extending groove 112. Referring to FIG. 2, guide fences 120 and 122 having clamp mechanisms 124 and 126, respectively, may be provided for use with router bit 40 and circular saw blade 44, respectively, the non-clamp-bearing end of each fence being removably insertable into groove 112.

Workstation 10 may be economically constructed of suitable wood and metal components and furnished as a unit, with or without tools. Alternatively, metal parts, such as horizontal plate 50, shaft 52, end plate 54, pin 60, shelf 80, and double channel 110 may be furnished as a kit with plans for construction and assembly of the remaining components of workstation 10.

Upper surface 14 of workstation 10 preferably has the approximate dimensions of a basic contractor's table, 3½ feet wide by 8 feet long. So dimensioned, the workstation may be conveniently transported to a construction site in a pickup or other truck, with some or all of the tools mounted thereon.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A portable workstation, comprising:

(a) a support structure;

(b) a horizontal, generally planar, working surface disposed upon and supported by said support structure, said working surface comprising at least first and second stationary portions and at least one movable portion;

(c) said at least one movable portion comprising a horizontal mounting plate;

(d) adjacent edges of said first and second stationary portions are joined by a double channel member having outwardly facing U-shaped channels into which said adjacent edges are inserted substantially along the length thereof;

(e) said double channel member has a groove defined in the upper surface thereof extending the length thereof;

(f) at least one guide fence;

(g) said groove is adapted to have one end of a guide fence inserted therein, said guide fence extending between said groove and an edge of said working surface, the other end of said guide fence being mounted to a clamping mechanism, said clamping mechanism selectively securing said guide fence to said edge of said working surface.

(h) a plurality of tools, each of said tools being mounted on said at least one horizontal mounting plate, said horizontal mounting plate being rotatable such that said each of said plurality of tools may be selectively rotated between a working position, in which said tool is on top of said working surface, and a stored position in which said tool is underneath said working surface.

* * * * *